US007445373B2

(12) United States Patent
Huckby et al.

(10) Patent No.: US 7,445,373 B2
(45) Date of Patent: Nov. 4, 2008

(54) METHOD FOR MIXING A FLUID DISPERSION DISPOSED IN A CONTAINER HAVING EITHER A CYLINDRICAL OR SQUARE SHAPE

(75) Inventors: Dwight R. Huckby, Brookpark, OH (US); James E. MacDonald, Medina, OH (US); John T. O'Brien, Shaker Heights, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 0 days.

(21) Appl. No.: 11/928,655

(22) Filed: Oct. 30, 2007

(65) Prior Publication Data

US 2008/0049549 A1 Feb. 28, 2008

Related U.S. Application Data

(60) Continuation of application No. 11/487,612, filed on Jul. 17, 2006, now Pat. No. 7,325,968, which is a continuation of application No. 10/870,411, filed on Jun. 17, 2004, now Pat. No. 7,077,560, which is a division of application No. 10/268,137, filed on Oct. 8, 2002, now Pat. No. 6,817,751.

(60) Provisional application No. 60/327,929, filed on Oct. 9, 2001.

(51) Int. Cl.
*B01F 9/22* (2006.01)
*B01F 11/00* (2006.01)

(52) U.S. Cl. ..... 366/217; 366/605

(58) Field of Classification Search ..... 366/110, 366/111, 208–219, 236, 605, 349; 220/571.1, 220/625, 622, 737, 23.86, 608, 623, 631, 220/635, 669, 672–674; 215/370, 376
See application file for complete search history.

(56) References Cited

U.S. PATENT DOCUMENTS

| | | | | | |
|---|---|---|---|---|---|
| 285,174 | A | * | 9/1883 | Sterns | 366/216 |
| 1,292,127 | A | * | 1/1919 | Stevens | 366/217 |
| 1,301,536 | A | * | 4/1919 | Bee | 366/213 |
| 1,774,257 | A | * | 8/1930 | English | 366/217 |
| 2,006,451 | A | * | 7/1935 | Glidden | 366/213 |
| 2,022,527 | A | * | 11/1935 | Schletz | 366/211 |
| 2,121,165 | A | * | 6/1938 | Slobodkin | 220/574 |
| 2,843,302 | A | * | 7/1958 | Bandy | 220/737 |

(Continued)

FOREIGN PATENT DOCUMENTS

JP 08038871 A * 2/1996

(Continued)

*Primary Examiner*—Charles E Cooley
(74) *Attorney, Agent, or Firm*—Eryn Ace Fuhrer; Robert E. McDonald; Arthi K. Tirey

(57) ABSTRACT

Apparatus and method for mixing a fluid dispersion disposed in a container having either a cylindrical or a square shape. The apparatus includes a holding structure having a retaining structure connected to a base. The retaining structure prevents lateral movement of the container both when the container has a cylindrical shape and when the container has a generally square shape with a width substantially equal to the diameter of the cylindrical shape. The apparatus rotates the container about at least one axis.

5 Claims, 10 Drawing Sheets

U.S. PATENT DOCUMENTS 2,868,411 A * 1/1959 Kesselman ..... 220/737
2,894,309 A * 7/1959 Brzowski ..... 24/569
3,083,888 A * 4/1963 Miller ..... 229/400
3,301,534 A * 1/1967 Orser ..... 366/210
3,394,832 A * 7/1968 McAllister et al. ..... 220/254.3
3,421,053 A * 1/1969 Watson et al. ..... 361/149
3,503,592 A * 3/1970 Taylor et al. ..... 366/212
D217,231 S * 4/1970 Pashman ..... D9/782
3,542,344 A * 11/1970 Oberhauser ..... 366/202
3,583,623 A * 6/1971 Golner et al. ..... 229/406
3,643,671 A * 2/1972 Henninges et al. ..... 134/118
3,679,184 A * 7/1972 Woodham et al. ..... 366/219
3,778,033 A * 12/1973 Pullman ..... 366/219
3,885,357 A * 5/1975 Hoyt ..... 451/327
4,004,783 A * 1/1977 Wilson ..... 366/200
4,071,163 A * 1/1978 Martin ..... 220/630
4,077,613 A * 3/1978 Wilson ..... 366/213
4,100,616 A * 7/1978 Wilson ..... 366/213
4,134,689 A * 1/1979 Ahrenskou-Sorensen ... 366/110
4,183,677 A * 1/1980 de Bruyne ..... 366/209
4,227,625 A * 10/1980 Underwood ..... 220/789
4,235,553 A * 11/1980 Gall ..... 366/208
4,265,548 A * 5/1981 Hall ..... 366/208
4,329,068 A * 5/1982 Neuner et al. ..... 366/214
4,491,307 A * 1/1985 Ellefson ..... 269/55
4,497,581 A * 2/1985 Miller ..... 366/208
D279,763 S * 7/1985 Hestehave et al. ..... D9/528
4,530,442 A * 7/1985 Vogel et al. ..... 220/798
4,577,775 A * 3/1986 Kresin ..... 220/604
4,586,292 A * 5/1986 Carroll et al. ..... 451/329
4,728,197 A * 3/1988 Reinhard ..... 366/219
4,779,758 A * 10/1988 Chazal et al. ..... 229/5.84
4,842,415 A * 6/1989 Cane et al. ..... 366/110
D323,115 S * 1/1992 Kelsey ..... D9/423
5,167,448 A * 12/1992 Herold et al. ..... 366/213
5,197,802 A * 3/1993 Miller et al. ..... 366/217
5,268,620 A * 12/1993 Hellenberg ..... 318/114
5,269,438 A * 12/1993 Kelsey ..... 220/766
5,292,024 A * 3/1994 Koefelda et al. ..... 220/608
5,320,248 A * 6/1994 Jamieson, III ..... 220/669
5,352,037 A * 10/1994 Jouvin ..... 366/219
5,437,505 A * 8/1995 Sanders et al. ..... 366/209
D362,180 S * 9/1995 Haines ..... D9/424
5,462,353 A * 10/1995 Gatlin ..... 366/209
D372,197 S * 7/1996 Gough ..... D9/782
5,551,779 A * 9/1996 Gantner et al. ..... 366/217
5,711,601 A * 1/1998 Thomas et al. ..... 366/209
5,746,510 A * 5/1998 Mark et al. ..... 366/217
5,788,371 A * 8/1998 Neri et al. ..... 366/217
5,855,304 A * 1/1999 Dean et al. ..... 222/481
5,906,433 A * 5/1999 Mazzalveri ..... 366/209
5,906,434 A * 5/1999 Berrios ..... 366/213
5,971,199 A * 10/1999 Jackson et al. ..... 220/608
6,059,138 A * 5/2000 Labruyere ..... 220/574
6,105,799 A * 8/2000 Takagawa ..... 215/12.1
6,193,410 B1 * 2/2001 Puckett, II ..... 366/348
6,199,715 B1 * 3/2001 Hayes et al. ..... 220/608
6,365,115 B1 * 4/2002 Wood ..... 422/292
6,530,500 B2 * 3/2003 Bravo et al. ..... 222/143
6,612,732 B2 * 9/2003 Blakeman et al. ..... 366/209
6,709,151 B2 * 3/2004 Schmidt ..... 366/219
6,767,125 B2 * 7/2004 Midas et al. ..... 366/209
6,767,126 B2 * 7/2004 Miller ..... 366/217
6,817,751 B2 * 11/2004 Huckby et al. ..... 366/217
6,945,689 B2 * 9/2005 Armendariz et al. ..... 366/209
6,945,690 B2 * 9/2005 Armendariz et al. ..... 366/209
6,953,279 B2 * 10/2005 Midas et al. ..... 366/217
6,960,012 B1 * 11/2005 Biber ..... 366/110
6,988,824 B2 * 1/2006 Santospago et al. ..... 366/217
7,077,560 B2 * 7/2006 Huckby et al. ..... 366/209
7,182,505 B2 * 2/2007 Huckby ..... 366/217
7,182,506 B2 * 2/2007 Schulz et al. ..... 366/217
7,325,968 B2 * 2/2008 Huckby et al. ..... 366/209
2001/0025865 A1 * 10/2001 Bravo et al. ..... 222/465.1
2002/0195471 A1 * 12/2002 Nottingham et al. ..... 222/570
2003/0107949 A1 * 6/2003 Huckby et al. ..... 366/217
2003/0142583 A1 * 7/2003 Santospago et al. ..... 366/209
2003/0179646 A1 * 9/2003 Miller ..... 366/217
2003/0214878 A1 * 11/2003 Huckby ..... 366/217
2004/0013031 A1 * 1/2004 Salas et al. ..... 366/141
2004/0085855 A1 * 5/2004 Midas et al. ..... 366/209
2004/0141412 A1 * 7/2004 Midas et al. ..... 366/217
2004/0208083 A1 * 10/2004 Armendariz et al. ..... 366/209
2004/0240314 A1 * 12/2004 Armendariz et al. ..... 366/209
2005/0002273 A1 * 1/2005 Huckby et al. ..... 366/217
2005/0030834 A1 * 2/2005 Santospago et al. ..... 366/209
2005/0088910 A1 * 4/2005 Greco et al. ..... 366/209
2005/0141341 A1 * 6/2005 Greco et al. ..... 366/209
2005/0195685 A1 * 9/2005 Marshall et al. ..... 366/217
2005/0252921 A1 * 11/2005 Van Landingham ..... 220/608
2005/0286341 A1 * 12/2005 Midas et al. ..... 366/217
2006/0002228 A1 * 1/2006 Schulz et al. ..... 366/209
2006/0002229 A1 * 1/2006 Schulz et al. ..... 366/217
2006/0062077 A1 * 3/2006 Santospago et al. ..... 366/209
2006/0109739 A1 * 5/2006 Huckby ..... 366/208
2006/0109740 A1 * 5/2006 Huckby ..... 366/208
2006/0256648 A1 * 11/2006 Huckby et al. ..... 366/209
2007/0247967 A1 * 10/2007 Johnson et al. ..... 366/217
2008/0049549 A1 * 2/2008 Huckby et al. ..... 366/213

FOREIGN PATENT DOCUMENTS

JP 2005052737 A * 3/2005

* cited by examiner

METHOD FOR MIXING A FLUID DISPERSION DISPOSED IN A CONTAINER HAVING EITHER A CYLINDRICAL OR SQUARE SHAPE

CROSS-REFERENCE TO RELATED APPLICATION

This application is a continuation of application Ser. No. 11/487,612 filed Jul. 17, 2006, now U.S. Pat. No. 7,325,968 B2, which is a continuation of application Ser. No. 10/870,411, filed Jun. 17, 2004, now U.S. Pat. No. 7,077,560, which was a divisional of application Ser. No. 10/268,137, filed Oct. 8, 2002, now U.S. Pat. No. 6,817,751, which in turn claims the benefit of U.S. provisional patent application No. 60/327,929 filed on Oct. 9, 2001. The entirety of all of the priority applications listed in the previous sentence are hereby incorporated by reference.

BACKGROUND OF THE INVENTION

The present invention relates to the mixing of fluid dispersions and more specifically to apparatus and methods for mixing paint disposed in a container having either a cylindrical or a square shape.

As is well known, solids in fluid dispersions, such as paint, tend to settle in a downward direction through the force of gravity. Fluid dispersions disposed in containers for commercial sale are typically mixed in the containers before they are used by the purchasers. Many fluid dispersions can be facilely mixed in a container by manually shaking the container. Other fluid dispersions, however, such as paint, are more difficult to manually mix in a container and, thus, are often mixed in the container using a machine that shakes, rotates, vibrates or otherwise moves the container.

A variety of different types of mixing machines are known for mixing fluid dispersions disposed in containers. Examples of conventional mixing machines include those disclosed in U.S. Pat. No. 3,542,344 to Oberhauser, U.S. Pat. No. 4,235,553 to Gall, and U.S. Pat. No. 4,497,581 to Miller, all of which are hereby incorporated by reference. These and most other conventional mixing machines can only accommodate cylindrical containers. Such mixing machines cannot properly accommodate generally square containers. It has been proposed, however, to package fluid dispersions, such as paint, in generally square containers. An example of one such container is disclosed in U.S. Patent Application US2001/0025865A1 to Bravo et al. Accordingly, there is a need in the art for an apparatus and method for mixing fluid dispersions disposed in generally square containers as well as cylindrical containers. The present invention is directed to such an apparatus and method.

SUMMARY OF THE INVENTION

In accordance with the present invention, an apparatus is provided for mixing a fluid dispersion disposed in a container. The apparatus includes a holding structure for holding the container during the mixing of the fluid dispersion. The holding structure includes a retaining structure extending from a base. The retaining structure has a plurality of interior surfaces at least partially defining an interior void within which the container is disposed when the holding structure is holding the container. The interior surfaces include a pair of parallel and substantially planar first surfaces and a pair of parallel and substantially planar second surfaces. The first and second surfaces are arranged such that a line extending between the first surfaces intersects a line extending between the second surfaces. The holding structure is secured to a mounting support. An electric motor is connected to the mounting support for rotating the mounting support about at least one axis.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
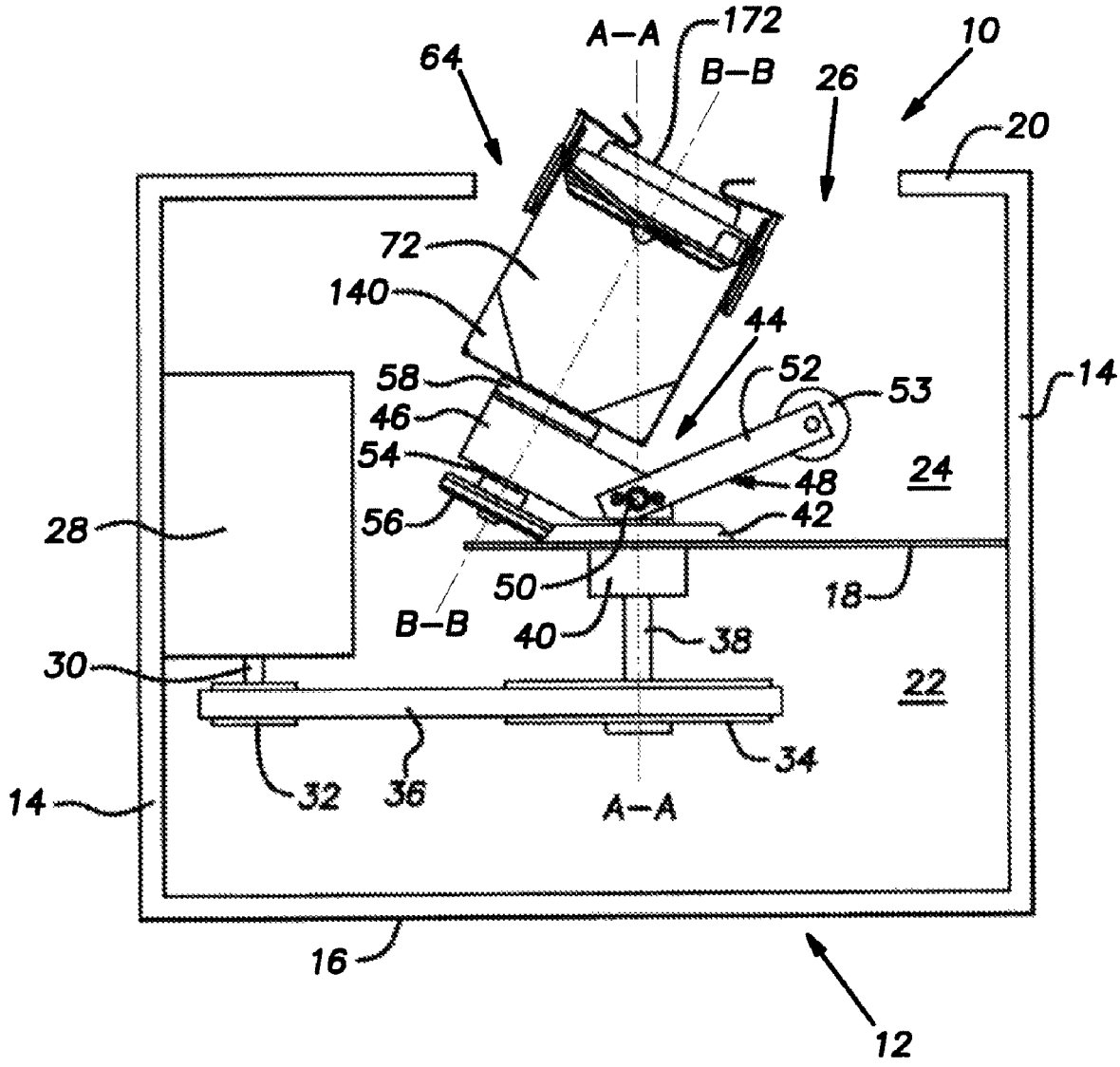
FIG. 1 shows a side view of a mixing apparatus having a cabinet with a portion cut away to better show the interior thereof.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

As used herein, the term "conventional 1 gallon paint container" shall mean a cylindrical metal container for holding paint, having a diameter of about $6\frac{10}{16}$ inches, a height of about $7\frac{11}{16}$ inches, an interior volume of slightly greater than 1 U.S. gallon, and including a bail handle secured to a pair of mounting ears, each with a diameter of about ¾ of an inch.

Referring now to FIG. 1, there is shown a mixing apparatus 10 embodied in accordance with the present invention. The mixing apparatus 10 is operable to mix a fluid dispersion, such as paint, that is disposed in either a cylindrical container or in a generally square container. For proper operation, the mixing apparatus 10 should be disposed on a substantially horizontal surface, and in the following description, it will be assumed that the mixing apparatus 10 is so disposed.

The mixing apparatus 10 includes a rectangular cabinet 12 having upstanding side walls 14, a bottom wall 16, an access door (not shown), an intermediate wall 18 and an upper wall 20. The intermediate wall 18 divides the cabinet 12 into a lower drive chamber 22 and an upper loading chamber 24. The access door closes an opening (not shown) that provides access to the drive chamber 22. The access door may be hinged to one of the adjacent side walls 14 so as to be pivotable between open and closed positions, or the access door may be removably disposed between the ends of two of the side walls 14. The upper wall 20 has an enlarged circular opening 26 formed therein, which provides access to the loading chamber 24. Although not shown, a hood may mounted to the cabinet 12, above the upper wall 20.

An electric motor 28 is mounted toward the rear of the cabinet 12 and extends between the drive chamber 22 and the loading chamber 24. A rotor shaft 30 of the electric motor 28 extends downwardly and is disposed in the drive chamber 22. A motor sprocket 32 with teeth is secured to an end of the rotor shaft 30. The motor sprocket 32 is drivingly connected to a larger diameter drive sprocket 34 by an endless belt 36 having interior ribs. The drive sprocket 34 is secured to a lower end of a vertical drive shaft 38 that extends upwardly through a bearing mount 40 and into the loading chamber 24 through an opening (not shown) in the intermediate wall 18. In the loading chamber 24, the drive shaft 38 extends through a central passage (not shown) in a pedestal 42 that is disposed on an upper side of the intermediate wall 18. An upper end of the drive shaft 38 is secured to a yoke 44 disposed in the loading chamber 24, above the pedestal 42. The bearing mount 40 is secured to the pedestal 42, with the intermediate wall 18 trapped in between. The bearing mount 40 has a plurality of bearings (not shown) disposed therein for rotatably supporting the drive shaft 38.

Figure 2:
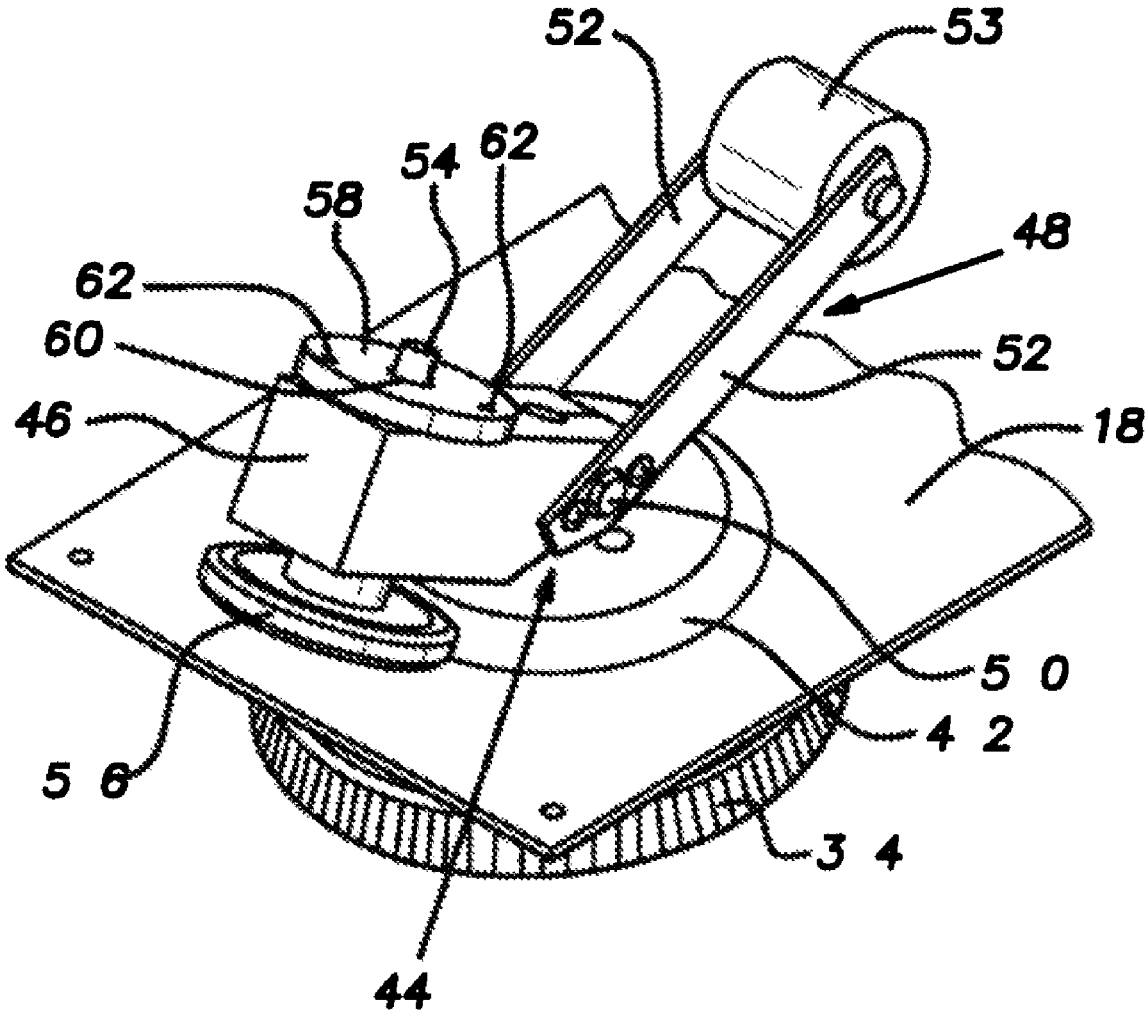
FIG. 2 shows a top perspective view of a portion of the mixing apparatus.

Referring now also to FIG. 2, the yoke 44 includes a mounting arm 46 and a balancing arm 48 secured together at their inner ends by a bolt 50 that also secures the upper end of the drive shaft 38 to the yoke 44. The mounting arm 46 and the balancing arm 48 extend outwardly in opposing lateral directions and extend upwardly at acute angles from the vertical. The balancing arm 48 is bifurcated and includes a pair of spaced-apart elongated plates 52. A cylindrical counterweight 53 is secured between outer ends of the plates 52. The counterweight 53 balances the yoke 44 when a container of a fluid dispersion, such as paint, is mounted to the mounting arm 46, as will be described more fully below.

A mounting shaft 54 rotatably extends through a passage (not shown) in the mounting arm 46. Bearings (not shown) may be disposed in the passage to reduce friction between the mounting shaft 54 and the mounting arm 46. A drive wheel 56 is secured to a bottom portion of the mounting shaft 54, below the mounting arm 46, while a mounting support 58 is secured to an upper portion of the mounting shaft 54, above the mounting arm 46. The mounting support 58 may circular (as shown) or square. The mounting support 58 includes a center passage 60 through which an upper end of the mounting shaft 54 extends. A plurality of threaded bores 62 are formed in the mounting support 58 and are disposed around the center passage 60.

The drive wheel 56 has a bevelled outer edge that is in frictional engagement with a mating bevelled side surface on the pedestal 42. When the yoke 44 rotates about an axis A-A (shown in FIG. 1) extending through the drive shaft 38 (as will be described more fully below), the drive wheel 56 is moved around the pedestal 42. Since the outer edge of the drive wheel 56 is in engagement with the bevelled surface on the pedestal 42, the drive wheel 56 rotates around an axis B-B (shown in FIG. 1) extending through the mounting shaft 54 (as will be described more fully below). The axis B-B extends upwardly and preferably intersects the axis A-A at an angle of from about 20° to about 40°, more preferably at an angle of about 30°. If the mixing apparatus 10 is disposed on a substantially horizontal surface, the axis A-A extends substantially vertical, i.e., at about 90° from the horizontal.

It should be appreciated that in lieu of the drive wheel 56 and the pedestal 42 being in frictional engagement, the drive wheel 56 and the pedestal 42 may be in positive mechanical engagement through the use of mating gear teeth formed in the edge of the drive wheel 56 and in the side surface of the pedestal 42.

For reasons that will be explained more fully below, the polarity of the electric motor 28 is set so as to rotate the yoke 44 about the axis A-A in a counter-clockwise direction, which causes the bucket 64 to rotate about the axis B-B in a counter-clockwise direction.

It should be appreciated that the present invention is not limited to the particular mechanical arrangement described above for rotating the mounting support 58 about a plurality of axes. Other known mechanical arrangements may be utilized for rotating the mounting support 58 about a plurality of axes.

Figure 3:
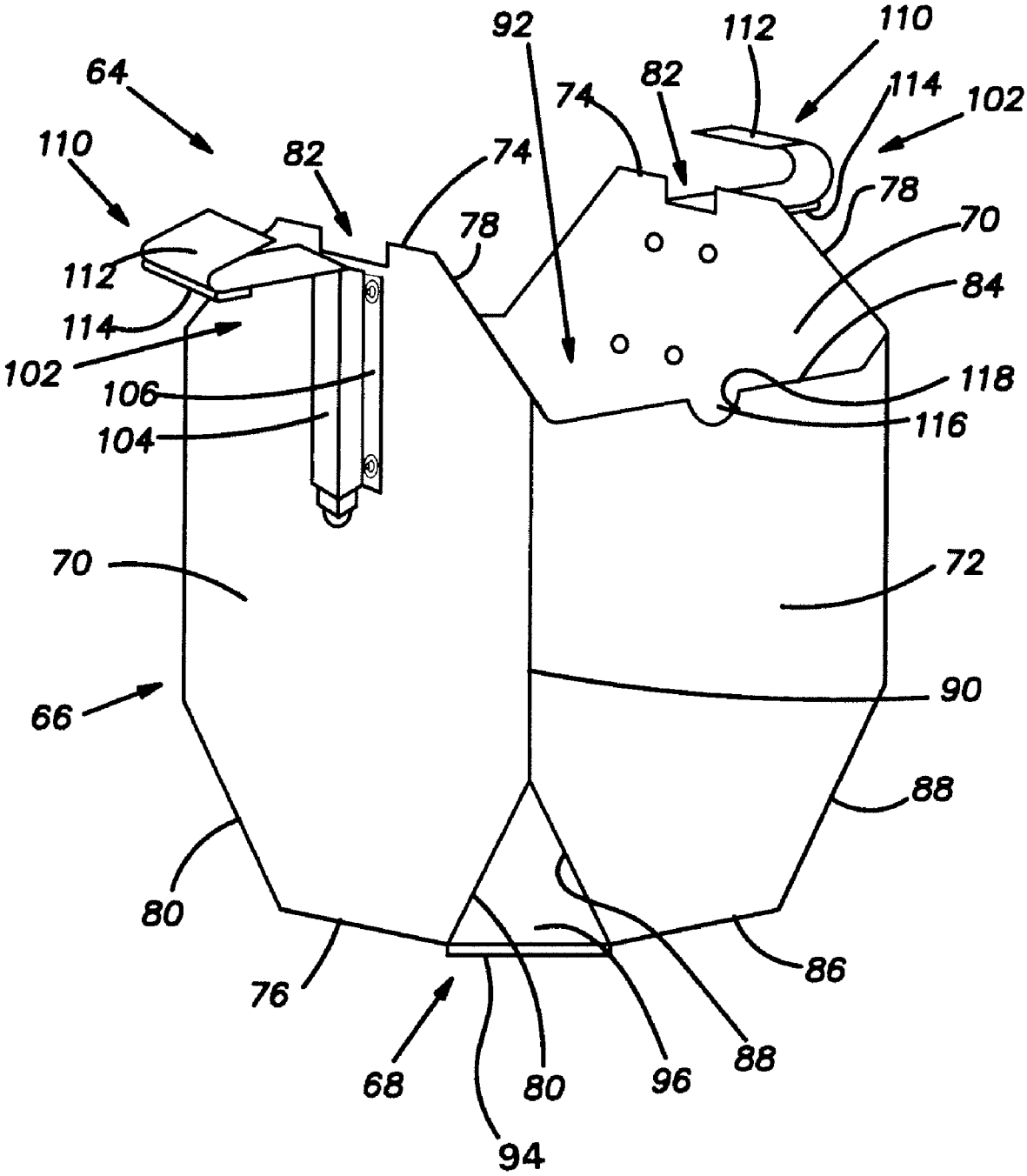
FIG. 3 shows a perspective view of a bucket of the mixing apparatus.
Figure 4:
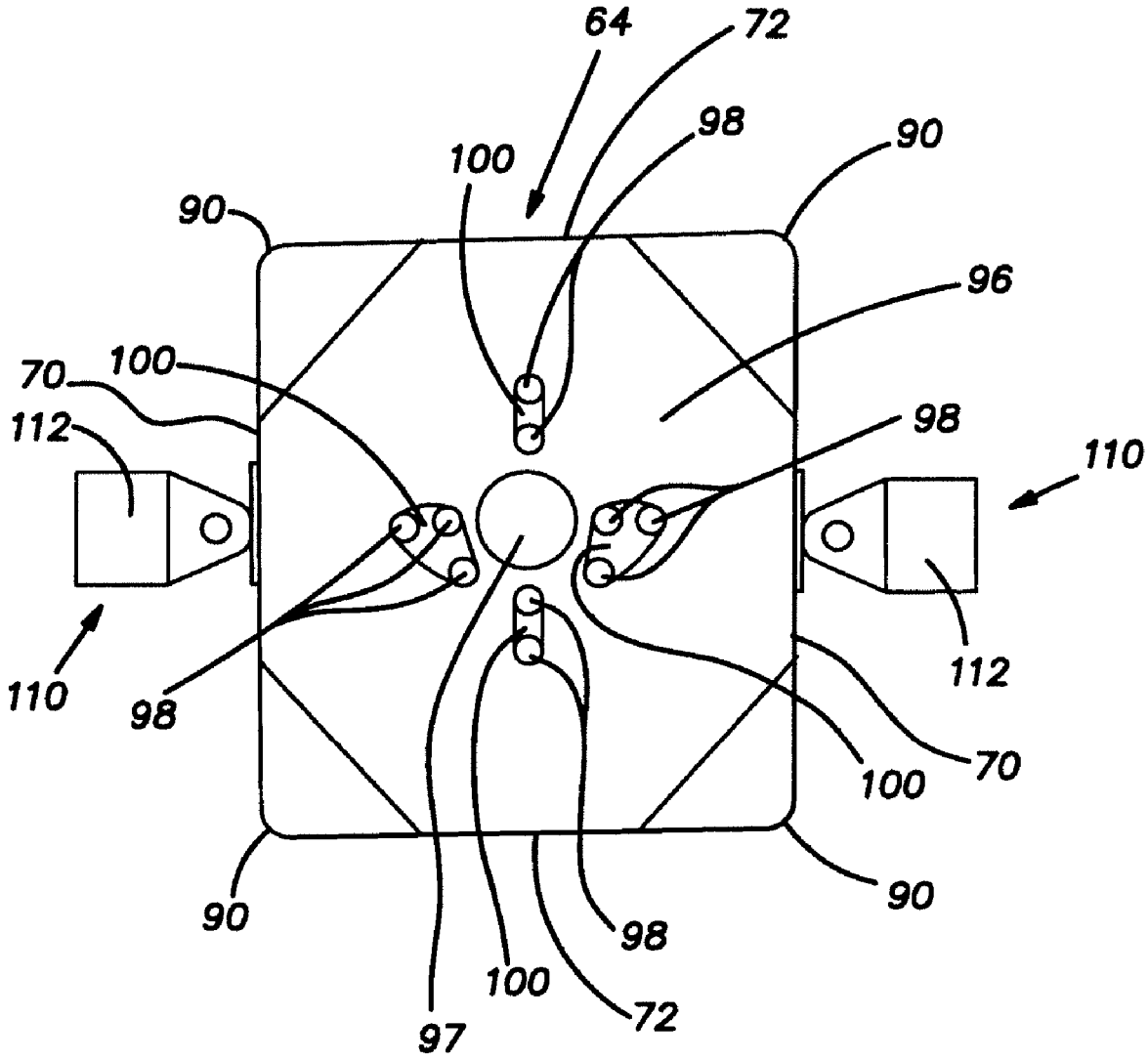
FIG. 4 shows a top plan view of the bucket.
Figure 5:
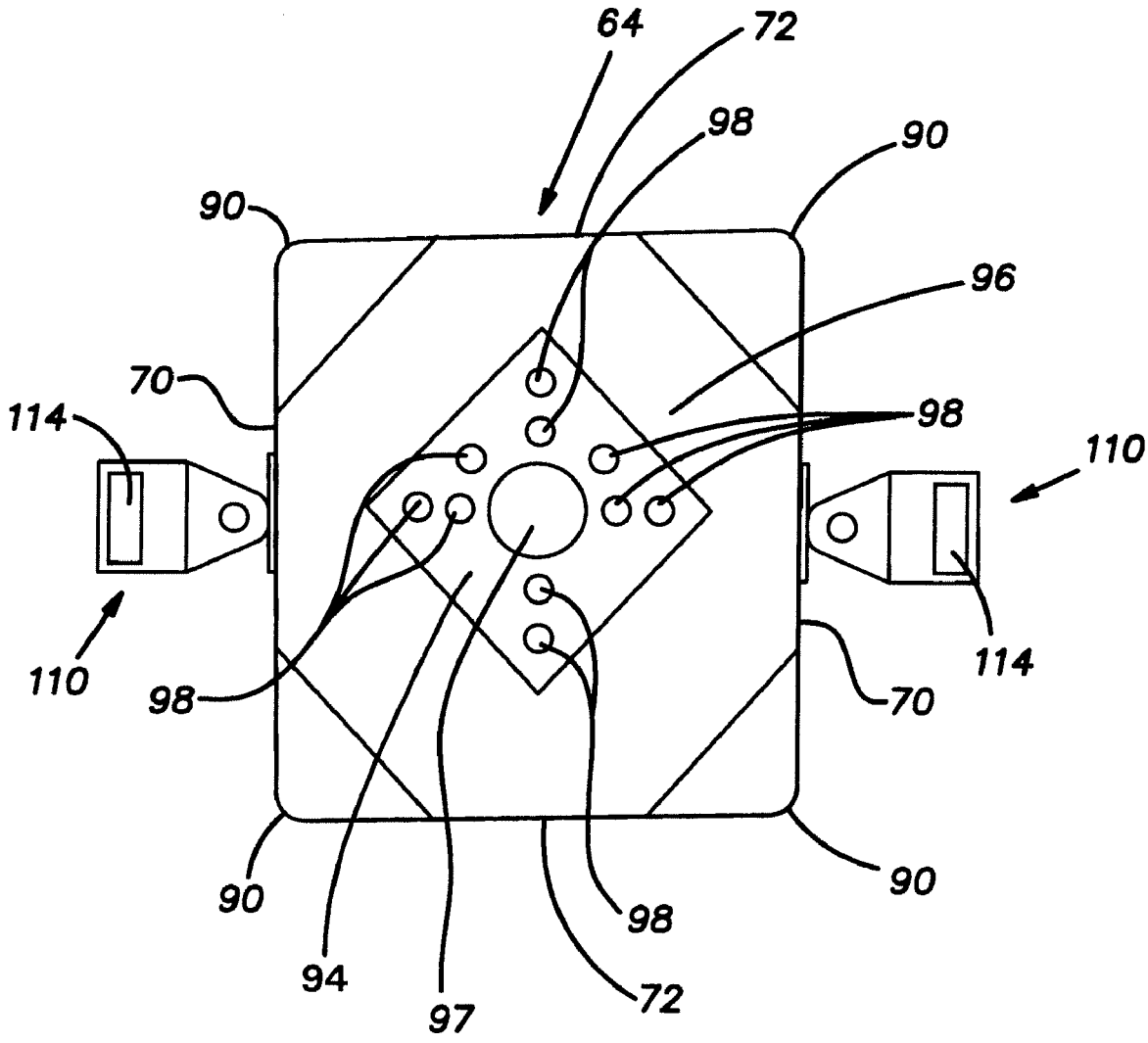
FIG. 5 shows a bottom plan view of the bucket.

Referring now to FIGS. 3-5 there are shown perspective and top and bottom views of a bucket 64 for holding a container of a fluid dispersion, such as paint. The bucket 64 includes a retaining structure 66 secured to a base 68. The retaining structure 66 is comprised of a pair of parallel and substantially planar first walls 70 and a pair of parallel and substantially planar second walls 72. The first walls 70 are generally octagonal, having horizontal top and bottom edges 74, 76 joined to vertical side edges by sloping upper side edges 78 and sloping lower side edges 80. Rectangular notches 82 are formed in the top edges 74 of the first walls 70. The second walls 72 are generally rectangular, having horizontal top and bottom edges 84, 86 joined by vertical side edges and sloping lower side edges 88. The first walls 70 and the second walls 72 are arranged such that a line extending between the first walls 70 intersects a line extending between the second walls 72. More specifically, the first and second walls 70, 72 are arranged to provide the retaining structure 66 with a substantially square cross-section. Preferably, the side edges of the first walls 70 are joined to side edges of the second walls 72 at curved or rounded corners 90 (best shown in FIGS. 4 and 5). In this manner, the retaining structure 66 defines an inner void or cavity 92 having a cross section that is square with rounded corners. The sloping lower side edges 80, 88 of the first and second walls 70, 72 permit the bucket 64 to freely rotate about the axis B-B without hitting the mounting arm 46 of the yoke 44, while the sloping upper side edges 78 of the first walls 70 permit the bucket 64 to freely rotate about the axis B-B without hitting the upper wall 20.

The base 68 includes a square mount 94 secured to a lower surface of an octagonal floor plate 96. The floor plate 96 is joined to the bottom edges 76, 86 of the first and second walls 70, 72 by welding or other means. An axial opening 97 located in the center of the floor plate 96 extends through the floor plate 96 and the mount 94. A plurality of mounting bores 98 are disposed around the axial opening 97 and extend through the mount 94 and the floor plate 96. The mounting bores 98 are arranged in groups located in four recessed areas 100 that form the corners of a square pattern. One of the mounting bores 98 in each group can be aligned with one of the threaded bores 62 in the mounting support 58. A plurality of the mounting bores 98 are provided in each of the recessed areas 100 to permit the mounting bores to be aligned with threaded bores in mounting supports of different types of mixing machines, wherein the threaded bores are arranged in different patterns.

A pair of clamping structures 102 are secured to the first walls 70, below and in alignment with the notches 82. Each clamping structure 102 comprises an elongated casing 104 joined to a mounting plate 106. The mounting plates 106 are secured to the first walls 70 by nuts and bolts or other means. Each casing 104 has a passage (not shown) with a square cross-section extending therethrough. A rod 108 (shown in FIGS. 12 and 13) is slidably disposed in each passage. Each rod 108 has a top portion with a square cross-section and a bottom portion with a circular cross-section. Each rod 108 is slidable between a contracted position, wherein the top portion of the rod 108 is disposed in the passage, and an extended position, wherein the top portion of the rod 108 is disposed exterior to the passage and above the casing 104. The square cross-sections of the top portions prevent the rods 108 from being rotated when the top portions are disposed in the passages of the casings 104 i.e., when the rods 108 are in their contracted positions. When the rods 108 are in their extended positions, however, the circular cross-sections of the bottom portions permit the rods 108 to be rotated. A top end of each rod is secured to a clamp 110 and a bottom end of each rod 108 is secured to a spring (not shown). The springs are secured to the casing 104 and bias the rods 108 toward their contracted positions. The clamps 110 are provided with hooks 112 that may be grasped by an operator when the operator desires to change the position of the clamps 110. Preferably, rubber pads 114 are secured to bottom surfaces of the clamps 110. When an operator pulls upwardly on the hooks 112 and moves the rods 108 to their extended positions, the clamps 110 may be rotated between a clamping position (shown in FIGS. 12 and 13), wherein the clamps 10 extend inwardly over the base, and a released position (shown in FIGS. 3-5 ), wherein the clamps 110 extend outwardly.

The bucket 64 is adapted for holding a conventional 1 gallon paint container. More specifically, the retaining structure 66 is constructed such that the width of the cavity 92 in the retaining structure 66, both in the direction between the first walls 70 and in the direction between the second walls 72, is slightly greater than 6 10/16 inches, which is about the diameter of a conventional 1 gallon paint container. In this manner, the cavity 92 of the retaining structure 66 can snugly accommodate a conventional 1 gallon paint container and a generally square container of paint having a width of about 6 10/16 inches. The height of the retaining structure 66, from the base 68 up to the top edges 74 of the first walls 70 is about 8 inches.

A pair of opposing slots 116 is formed in the second walls 72 to permit mounting ears on a conventional 1 gallon paint container to extend through the retaining structure 66. The slots 116 are centrally disposed along the width of the second walls 72 and are defined by semi-circular interior side edges 118 extending downwardly from the top edges 84 of the second walls 72. The width of each slot 116 is large enough to permit a mounting ear of a conventional 1 gallon paint container to extend therethrough. Thus, each slot 116 has a width of at least ¾ of an inch.

The retaining structure 66 may be constructed from two pieces of sheet metal that are joined together at a pair of spot-welded seams (not shown), which are preferably located opposite each other in the second walls 72, below and in alignment with the slots 116. The sheet metal may be powder coated to enhance the appearance of the retaining structure 66 and to protect it from corrosion.

Although the bucket 64 is described above as being constructed from two separate metal structures, namely the retaining structure 66 and the base 68, it should be appreciated that the bucket 64 could be a unitary structure composed of plastic, such as high density polyethylene.

Figure 6:
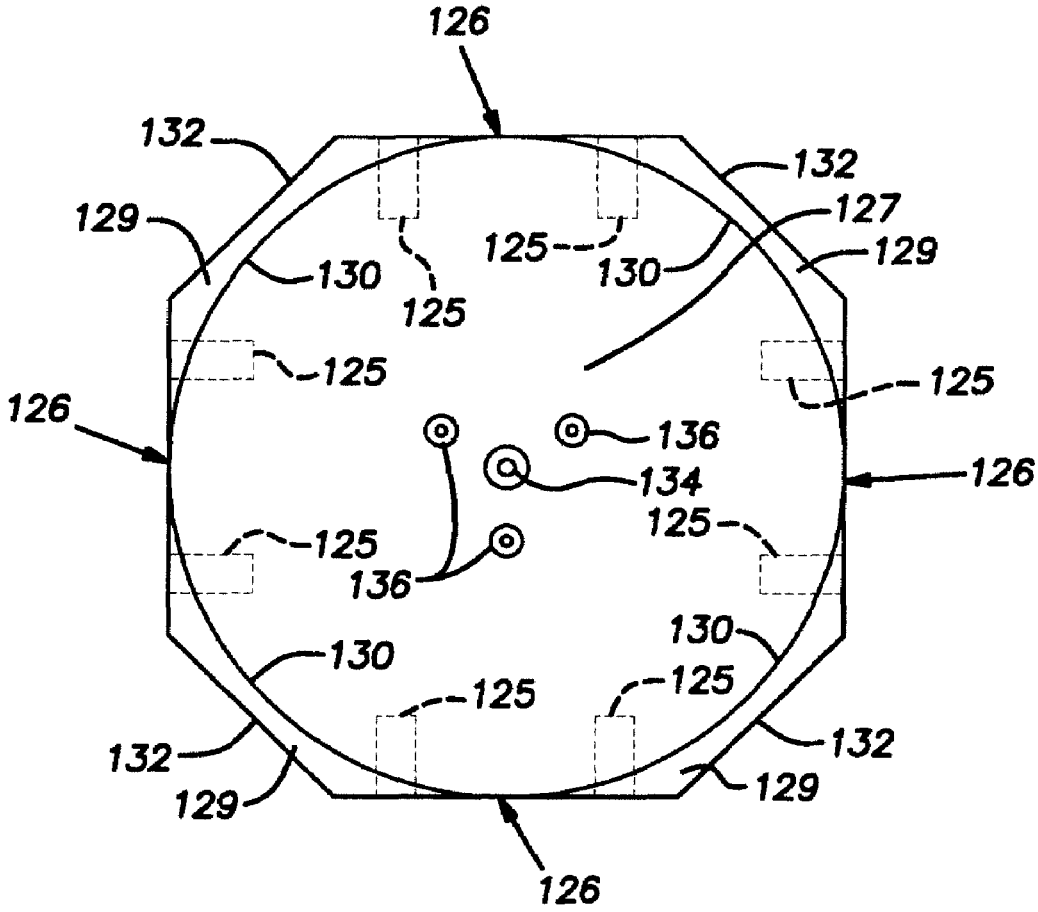
FIG. 6 shows a top plan view of a base of a bucket constructed in accordance with a second embodiment of the present invention.
Figure 7:
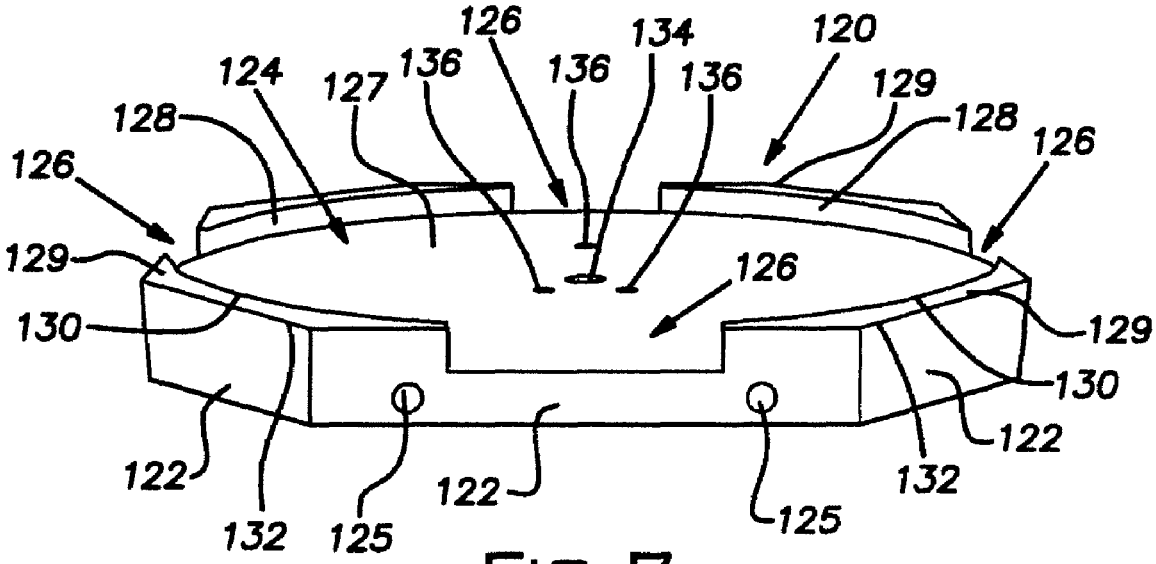
FIG. 7 shows a top perspective view of the base of the second embodiment.

Referring now to FIGS. 6 and 7, there is respectively shown a top plan view and a side perspective view of a base 120 that may be used in lieu of the base 68 in a second embodiment of the present invention. The base 120 is composed of metal and is octagonal in shape, having eight exterior side surfaces 122. An enlarged circular recess 124 is formed in the top of the base 120. The recess 124 has a diameter equal to the width (between any opposing pair of exterior side surfaces 122) of the base 120. In this manner, the recess 124 forms a rectangular opening 126 in every other one of the exterior side surfaces 122. In each such exterior side surface 122 with a rectangular opening 126, a pair of threaded lateral bores 125 are formed in the base 68 on opposing sides of the rectangular opening 126.

The recess 124 is defined by a circular interior bottom surface 127 and four arcuate interior side surfaces 128. A plurality of top surfaces 129 are disposed above and radially outward from the interior bottom surface 127. The top surfaces 129 have arcuate interior edges 130 formed by the interior side surfaces and angled exterior edges 132 formed by the exterior side surfaces 122. The top surfaces 129 are parallel to the interior bottom surface 127. An axial opening 134 located in the center of the interior bottom surface 127 extends through the base 120. A plurality of countersunk holes 136 are disposed around the axial opening 134 and extend through the base 120 as well. The base 120 is secured to the mounting support 58 by disposing the base 120 on the mounting support 58 such that the mounting shaft 54 extends through the axial opening 134 and the countersunk holes 136 are aligned with the bores 62 in the mounting support 58. Bolts (not shown) are inserted through the countersunk holes 136 and are threaded into the bores 62.

The recess 124 has a diameter of about 6 10/16 inches, which, once again, is about the diameter of a conventional 1 gallon paint container. In this manner, a bottom portion of a conventional paint container can be disposed in the recess 124 and supported on the interior bottom surface 127, while a generally square container of paint having a width of about 6 10/16 can be supported on the top surfaces 129.

In the second embodiment, the base 120 may be secured to the retaining structure 66 by bolts inserted through holes formed in the first or second walls 70, 72 and threaded into the lateral bores 125, thereby forming a bucket of the second embodiment.

Figure 8:
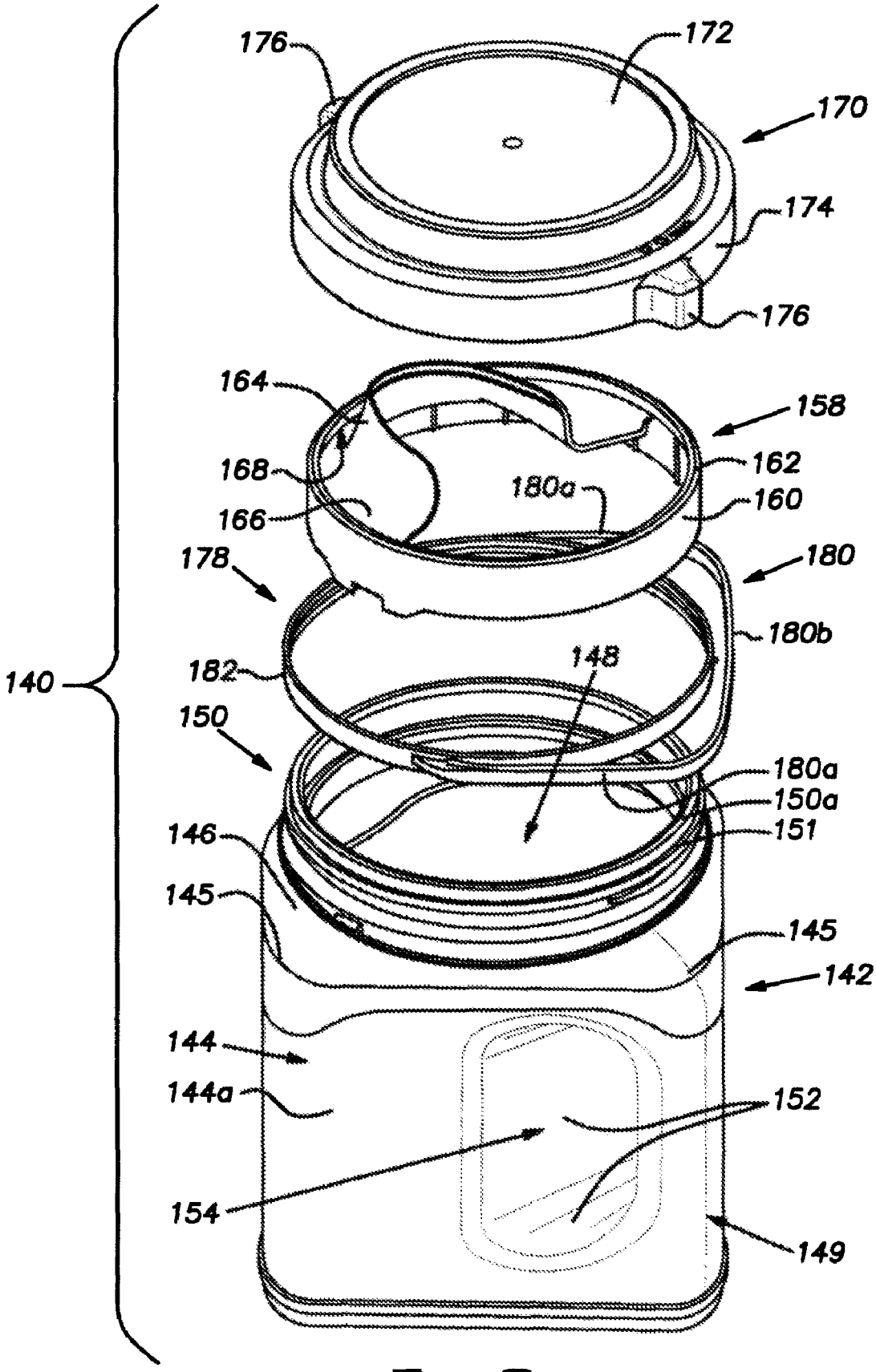
FIG. 8 shows an exploded view of a square plastic paint container for use in the mixing apparatus.

The bucket 64 is adapted to hold a generally square paint container, such as the paint container shown in FIG. 8. The container 140 comprises a plastic body 142 defining an interior volume for holding a fluid dispersion, such as architectural paint. The body 142 has a generally square shape with generally square side walls 144 and is preferably blow molded from high density polyethylene. Each of the side walls 144 includes a recessed label-saver region 144*a* having a thickness of about 0.06 inches. The side walls 144 are joined at two rounded side corners 145, a handle corner 149 and a sloping front corner (not shown). The body 142 also includes a bottom wall (not shown) and a top wall 146 with an enlarged opening formed therein. A collar 150 with an external thread 151 is disposed around the opening in the top wall 146 and extends upwardly therefrom. The collar 150 terminates in an upper rim 150*a* defining an access opening 148, which is sized to permit a conventional paint brush to extend therethrough. More specifically, the access opening 148 preferably has a diameter greater than about 4 inches, more preferably greater than about 5 inches.

When the interior volume of the body 142 is filled with a heavy fluid dispersion, such as architectural paint, the side walls 144 (and more particularly the recessed label-saver regions 144*a*) are sufficiently flexible to bow outwardly a small amount.

The body 142 has a plurality of inner walls 152 defining a handle passage 154. A handle 156 is formed at the handle corner 149 of the body 142 and extends vertically across the handle passage 154. An innermost one of the inner walls 152 that defines the handle passage 154 is disposed laterally inward from the collar 150. In this manner, a portion of the handle passage 154 is disposed laterally inward from the collar 150.

A pouring insert 158 is provided for removable mounting in the access opening 148 of the container 140. The pouring insert 158 comprises an annular mounting ring 160 having a skirt 162 for disposal over the upper rim 150*a* of the container 140. A pour spout 164 is disposed radially inward from the mounting ring 160 and is joined thereto by a curved wall 166. The pour spout 164 is arcuate and extends above the upper rim 150*a*. The apex of the pour spout 164 is spaced about ½ an inch from the upper rim 150*a* when the pouring insert is properly disposed in the access opening 148. The curved wall 166 slopes downwardly as it extends rearwardly, toward the handle 156. The curved wall 166, the mounting ring 160 and the pour spout 164 define a drainage groove 168 that collects paint drips from the pour spout 164 and permits the collected paint to flow back into the container 140.

A tiered lid 170 is provided for closing the access opening 148. The lid 170 comprises a cylindrical top portion 172 joined to a larger cylindrical bottom portion 174. A pair of grip tabs 176 extend radially outward from an outside surface of the bottom portion 174. The bottom portion 174 has an internal thread (not shown) for engaging the thread 151 of the collar 150 to threadably secure the lid 170 to the collar 150. The external thread 151 of the collar 150 and the internal thread of the lid 170 are configured such that rotation of the lid 170 in a clock-wise direction tightens the lid 170 to the collar 150 and conversely, rotation of the lid 170 in a counter clock-wise direction loosens the lid 170 from the collar 150.

The width of the container 140 is substantially the same as the diameter of a conventional one gallon paint container, namely about 6 10/16 inches. The height of the container 140, up to the top of the lid 170 (when it is securely threaded to the collar 150) is about 8 inches. The interior volume of the container 140 is slightly greater than 1 U.S. gallon.

The container 140 includes a bail handle structure 178 composed of plastic and comprising a bail handle 180 integrally joined at opposing ends to an annular band 182. The handle 180 is generally rectangular and has two legs 180*a* joined to opposing ends of a central member 180*b* so as to be generally perpendicular thereto. Preferably, the band 182 is constructed to be expandable so that the band 182 can be snapped over the collar 150 and trapped under a lowermost turn of the threads 151. The band 182 can be rotated around the collar 150 between a flush position, wherein the legs 180*a* and central member 180*b* are substantially parallel to and flush with the side walls 144 of the body 142, and an extended position, wherein the legs 180*a* and the central member 180*b* are disposed at oblique angles to the side walls 144, thereby forming protruding loops. The bail handle 180 can be flexed to a carrying position, wherein the handle 180 is substantially perpendicular to the band 182.

Figure 9:
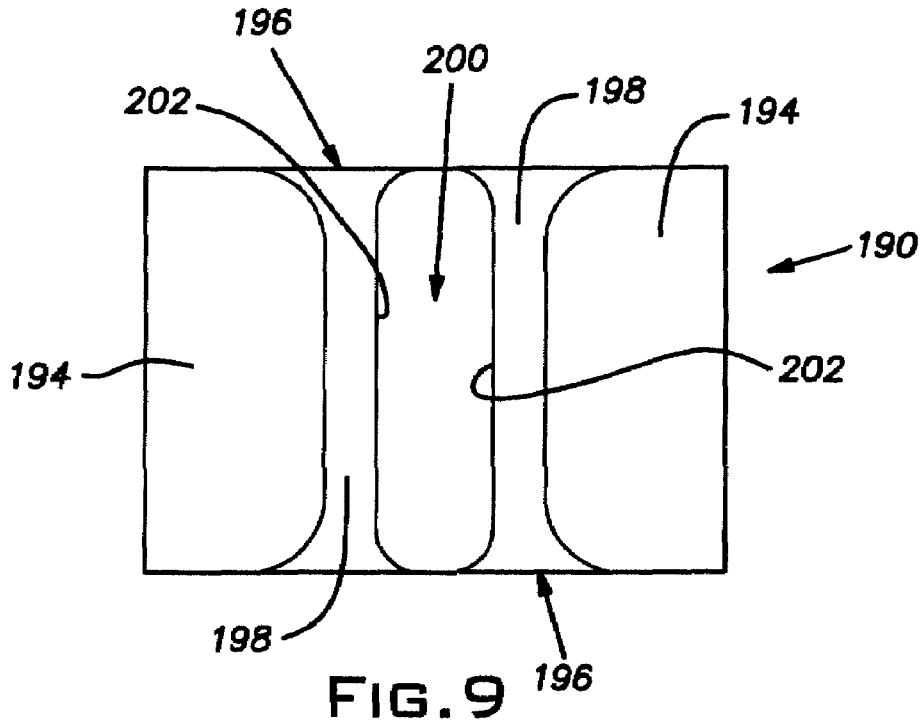
FIG. 9 shows a top plan view of a handle insert for disposal in a handle passage of the generally square paint container.
Figure 10:
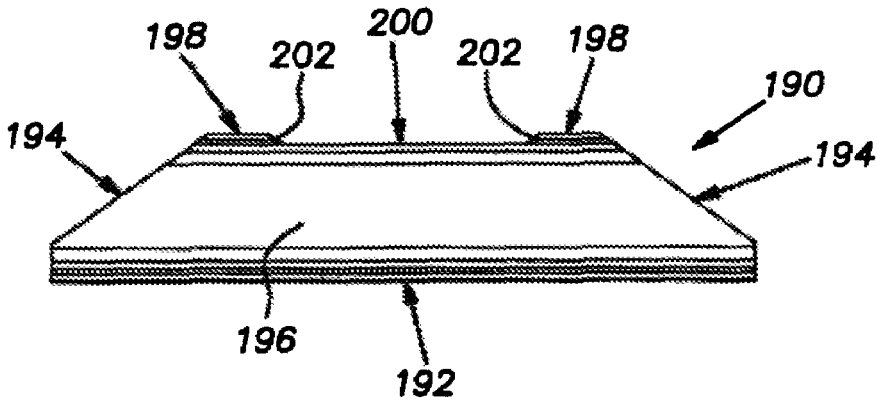
FIG. 10 shows a side elevational view of the handle insert.
Figure 11:
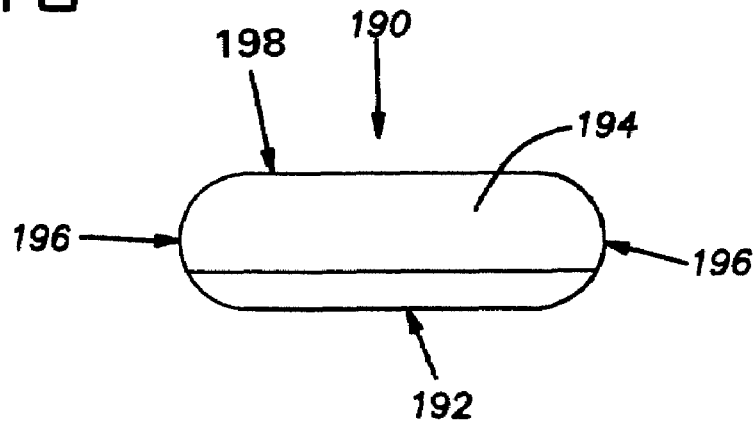
FIG. 11 shows an end elevational view of the handle insert.

When the mixing apparatus 10 is used to mix paint in the paint container 140 (or another container having a body with an integral handle formed therein), a handle insert 190 (shown in FIGS. 9-11) can be utilized to provide a more even weight distribution throughout the volume displacement of the paint container 140, thereby preventing unbalanced forces from excessively shaking or vibrating the mixing apparatus 10 during its operation. The handle insert 190 has a weight of from about 14 ounces to about 15 ounces and generally has the shape of a pyramidal frustum. The handle insert 190 includes a planar rear surface 192, inwardly sloping end surfaces 194, and rounded side surfaces 196. A front surface 198 of the handle insert 190 has an enlarged groove 200 formed therein for receiving an interior portion (formed by one or more of the inner walls 152) of the handle 156 of the paint container 140. The groove 200 is partially defined by a pair of parallel, spaced-apart interior ridges 202.

The handle insert 190 is inserted into the handle passage 154 of the paint container 140 by partially inserting one of the end surfaces 194 into the handle passage 154 so as to contact the interior portion of the handle 156. A force directed toward the handle passage 154 is then applied to the handle insert 190. The slope of the end surface 194 of the handle insert 190 translates the handle recess-directed force to an outwardly-directed force that flexes the handle 156 of the paint container outwardly, thereby permitting the handle insert 190 to be fully disposed in the handle passage 154. In this manner, the end surface 194 of the handle insert 190 acts as a cam surface. Once the handle insert 190 is positioned in the handle passage 154, the handle 156 resiliently moves back inwardly so as to trap the interior portion of the handle 156 between the interior ridges 202. With the interior portion of the handle 156 so trapped, the handle insert 190 is secured from movement in the handle passage 154. When the handle insert 190 is disposed in the handle passage 154 as described above, the end surfaces 194 of the handle insert 190 are substantially coplanar with the respective side walls 144 of the paint container 140 through which the handle passage 154 extends.

Figure 12:
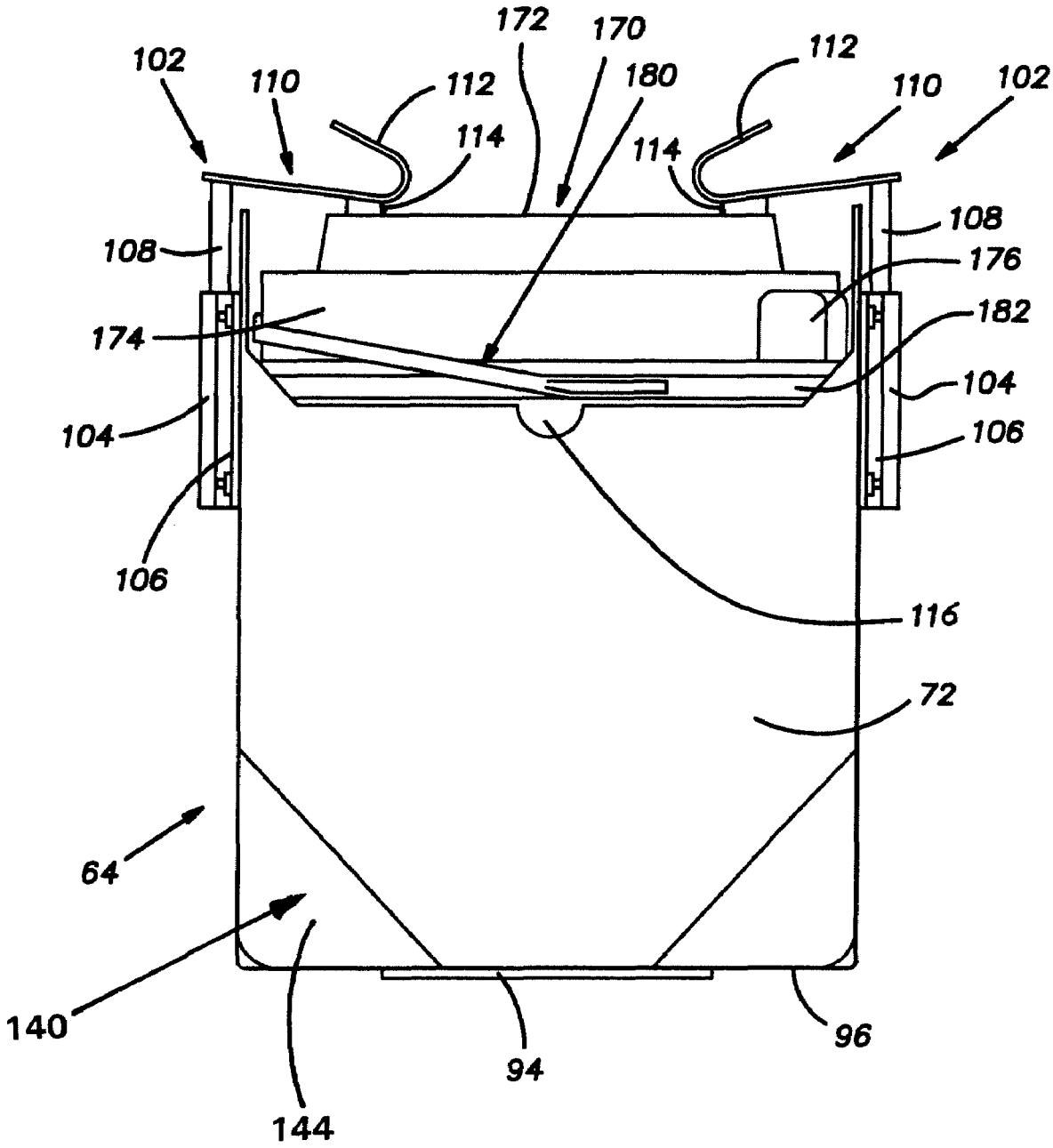
FIG. 12 shows a side elevational view of the generally square paint container disposed in the bucket of the mixing apparatus.

Referring now to FIG. 12, there is shown a perspective view of the paint container 140 secured in the bucket 64. The interior volume of the paint container 140 is filled with architectural paint. Although not shown, the bottom wall of the paint container 140 rests on and is supported by the floor plate 96. Since the interior volume of the paint container 140 is filled with paint, the side walls 144 (and more particularly the recessed label-saver regions 144*a*) are bowed outwardly and contact the first and second walls 70, 72 of the retaining structure 66. In this manner, the first and second walls 70, 72 substantially prevent any lateral movement of the paint container 140 within the bucket 64. Although not shown, one of the pairs of the first and second walls 70, 72 abut or are in close proximity to the end surfaces 194 of the handle insert 190. In this manner, the handle insert 190 is held between one of the pairs of the first and second walls 70, 72 during the rotation of the paint container 140, thereby further securing the handle insert 190 from movement in the handle passage 154.

The clamps 110 are in the clamping position and extend over the lid 170 of the paint container 210. The rods 108 are in their contracted positions and the clamps 110 are urged downwardly by the bias of the springs in the clamping structures 102, which presses the rubber pads 114 against the top portion 172 of the lid 170. In this manner, the paint container 140 is trapped between the floor plate 96 and the clamps 110, thereby securing the paint container 140 in the bucket 64.

Figure 13:
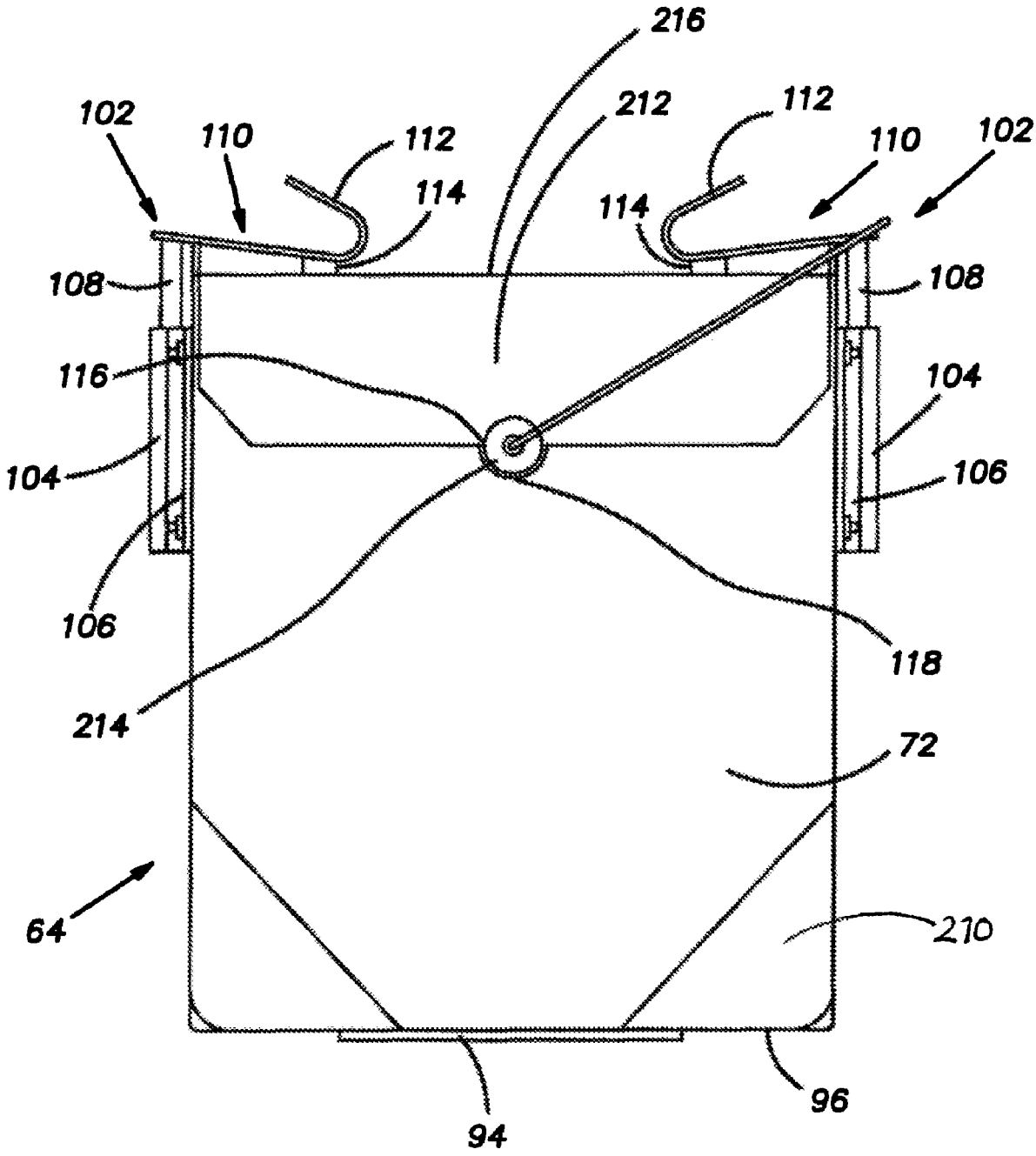
FIG. 13 shows a side elevational view of a conventional 1 gallon paint container disposed in the bucket of the mixing apparatus.

Referring now to FIG. 13, there is shown a perspective view of a conventional 1 gallon paint container 210 disposed in the bucket 64. Although not shown, a bottom end wall of the paint container 210 rests on and is supported by the floor plate 96 of the base 68. Middle portions of the first walls 70 of the retaining structure 66 abut or are in close proximity to a pair of opposing first portions of a cylindrical side wall 212 of the paint container 210, while middle portions of the second walls 72 of the retaining structure 66 abut or are in close proximity to a pair of opposing second portions of the cylindrical side wall 212, wherein a line extending through the pair of the opposing first portions of the cylindrical side wall 212 intersects a line extending through the pair of the opposing second portions of the cylindrical side wall 212 at a substantially right angle. In this manner, the paint container 210 is snugly disposed in the cavity 92 and the retaining structure 66 substantially prevents any lateral movement of the paint container 210 within the bucket 64. Ears 214 of the paint container 210 extend through the slots 116 in the second walls 72 of the retaining structure 66.

The clamps 110 are in the clamping position and extend over a chime lid 216 of the paint container 140. The rods 108 are in their contracted positions and the clamps 110 are urged downwardly by the bias of the springs in the clamping structures 102, which presses the rubber pads 114 against the lid 216. In this manner, the paint container 210 is trapped between the floor plate 96 and the clamps 110, thereby securing the paint container 210 in the bucket 64.

Referring back to FIG. 1, the bucket 64 is secured to the mounting support 58 by disposing the bucket 64 on the mounting support 58 such that the mounting shaft 54 extends through the axial opening 97 in the base 68 and the mounting bores 98 are aligned with the bores 62 in the mounting support 58. Bolts (not shown) are inserted through the bores 98 and are threaded into the bores 62. With the bucket 64 secured to the mounting support 58 in the foregoing manner, the bucket 64 extends upwardly, through the circular opening 26 in the cabinet 12, thereby making the bucket 64 readily accessible to an operator. The central axis of the bucket 64 is colinear with the axis B-B and, thus, preferably intersects axis A-A at an angle of from about 20° to about 40°, more preferably at an angle of about 30°.

As shown in FIG. 1, the paint container 140 is securely disposed in the bucket 64 as described above with reference to FIG. 12. When the electric motor 28 is provided with power, the rotor shaft 30 and, thus, the motor sprocket 32 rotate. The belt 36 transfers the rotation of the motor sprocket 32 to the drive sprocket 34, thereby causing the drive sprocket 34 and, thus, the drive shaft 38 to rotate. The rotation of the drive shaft 38 causes the yoke 44 to rotate about the axis A-A in a counter-clockwise direction which, in turn, causes the drive wheel 56 and the mounting support 58 to rotate about the axis B-B in a counter-clockwise direction. As a result, the bucket 64 and, thus, the paint container 140 are simultaneously rotated about the axis A-A and the axis B-B, thereby mixing the paint in the paint container 140. When the paint container 140 is rotating around the axes A-A and B-B, the side walls 144 (and more particularly the recessed label-saver regions 144*a*) bow outwardly even more due to the centrifugal forces being applied to the paint and press against the first and second walls 70, 72 of the bucket 64.

It has been observed that when the paint container 140 is rotated about the axes A-A and B-B in a clockwise direction, paint sometimes leaks from the juncture between the lid 170 and the collar 150. Conversely, it has been observed that when the paint container 140 is rotated about the axes A-A and B-B in a counter-clockwise direction, paint does not leak from the juncture between the lid 170 and the collar 150. Without being limited by any particular theory, it is believed that when the paint container 140 is rotating, the movement of the architectural paint disposed in the interior volume of the paint container 140 lags behind the movement of the paint container 140 due to the viscous nature of the paint. As a result, it is believed that the paint creates a force against the lid 170 that is directed opposite to the direction the paint container 140 is rotating. If the paint container 140 is rotating counter-clockwise, it is believed that the force against the lid 170 is directed clockwise, which tends to tighten the lid 170 to the collar 150. If the paint container 140 is rotating clockwise, it is believed that the force against the lid 170 is directed counter-clockwise, which tends to loosen the lid 170 from the collar 150. Accordingly, it is preferred to have the polarity of the electric motor 28 set so as to rotate the yoke 44 about the axis A-A in a counter-clockwise direction, which causes the paint container 140 to rotate about the axis B-B in a counter-clockwise direction.

The mixing apparatus 10 is very effective in mixing fluid dispersions disposed in either a cylindrical container or in a generally square container. In fact, Applicant has found that the mixing apparatus 10 is significantly more effective in mixing a fluid dispersion disposed in a generally square container, such as the paint container 140, than in a cylindrical container, such as a conventional paint container. This result was surprising and unexpected. Without being limited by any particular theory, it is believed that the walls 144 of the paint container 140 act like paddles to increase agitation of the fluid dispersion disposed in the interior volume of the paint container 140.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. A method of mixing architectural paints, said method comprising the steps of:

providing a holding structure having a retainer extending from a base, said retainer including a plurality of interior surfaces at least partially defining an interior holding space having a substantially rectangular cross-section;

providing a plastic container filled with paint, said container comprising a body defining an interior volume containing the paint, said body having a substantially rectangular cross-section;

disposing the plastic container in the interior holding space of the holding structure;

rotating the holding structure with the plastic container disposed therein about a first axis;

removing the plastic container from the interior holding space of the holding structure;

disposing a conventional 1 gallon paint container filled with paint in the interior holding space of the holding structure; and rotating the holding structure with the conventional 1 gallon paint container disposed therein about the first axis.

2. The method of claim 1, wherein the plastic container has a width that is substantially the same as the diameter of a conventional 1 gallon paint container.

3. The method of claim 1, wherein the holding structure comprises a base having a plurality of upwardly extending structures.

4. The method of claim 3, wherein when the plastic container is disposed in the interior holding space of the holding structure, the plastic container is supported on the upwardly extending structures above the floor.

5. The method of claim 3, wherein when the conventional 1 gallon paint container is disposed in the interior holding space of the holding structure, the conventional 1 gallon paint container is supported on the floor.

* * * * *